US007581579B2

(12) United States Patent
McCormick et al.

(10) Patent No.: US 7,581,579 B2
(45) Date of Patent: Sep. 1, 2009

(54) OPERATING DEVICE FOR A WINDOW COVERING

(75) Inventors: Gregory Radcliffe McCormick, Gloucestershire (GB); Michael Mosley, Gloucestershire (GB)

(73) Assignee: Hunter Douglas Industries B.V. (NL)

( * ) Notice: Subject to any disclaimer, the term of this patent is extended or adjusted under 35 U.S.C. 154(b) by 285 days.

(21) Appl. No.: 11/421,699

(22) Filed: Jun. 1, 2006

(65) Prior Publication Data

US 2006/0283559 A1 Dec. 21, 2006

(30) Foreign Application Priority Data

Jun. 21, 2005 (GB) ..... 0512576.0

(51) Int. Cl.
*A47G 5/02* (2006.01)

(52) U.S. Cl. ..... 160/309

(58) Field of Classification Search ..... 160/309, 160/98, 107; 74/89.18, 89.2, 130; 472/75, 472/77, 78, 79; 273/407, 476–478
See application file for complete search history.

(56) References Cited

U.S. PATENT DOCUMENTS 1,276,164 A * 8/1918 Black ..... 74/130
1,434,506 A * 11/1922 Seiss ..... 116/144
3,229,410 A * 1/1966 Bross ..... 446/179
3,229,413 A * 1/1966 Bross ..... 446/39
3,229,414 A * 1/1966 Bross ..... 446/38
3,229,416 A * 1/1966 Bross ..... 446/38
3,237,342 A * 3/1966 Bross ..... 446/38
3,342,243 A 9/1967 Salter
3,487,709 A 1/1970 Zieber, Jr.
3,572,153 A * 3/1971 Dove ..... 74/422
3,700,239 A * 10/1972 Paterick et al. ..... 473/570
3,822,606 A * 7/1974 Yoshino ..... 74/422
3,845,669 A * 11/1974 Pickles ..... 74/422
3,932,957 A * 1/1976 Morrison et al. ..... 446/234
4,400,913 A * 8/1983 Krantz et al. ..... 49/352
4,592,245 A * 6/1986 Pickles ..... 74/89.21
4,618,330 A * 10/1986 Abe ..... 446/236
4,685,248 A * 8/1987 Hammond ..... 49/352
4,799,916 A * 1/1989 McKay et al. ..... 446/444
4,959,035 A * 9/1990 Murasaki ..... 446/40
5,092,387 A * 3/1992 King et al. ..... 160/176.1 R
5,396,945 A * 3/1995 Meyer ..... 160/177 R
5,440,944 A * 8/1995 Chen ..... 74/89.21
5,466,030 A * 11/1995 Harris et al. ..... 296/98

(Continued)

FOREIGN PATENT DOCUMENTS

DE 1 926 811 11/1965

(Continued)

*Primary Examiner*—Katherine W Mitchell
*Assistant Examiner*—Jaime F Cardenas-Garcia
(74) *Attorney, Agent, or Firm*—Dorsey & Whitney LLP

(57) ABSTRACT

An operating device 10 for a window covering, comprising a telescopically extendable and retractable handle 12 and means for converting linear telescopic movement of the handle to rotational movement for moving the window covering. Preferably, the movement converting means includes a rack and pinion mechanism 22, 30 supported by a support member 14 of the operating device 10, one end of a rack 22 element of the rack and pinion mechanism being attached to a distal part of the telescopic handle 12, and a pinion gear 30 being provided on the support member 14 and drivable by the rack element 22.

6 Claims, 5 Drawing Sheets

U.S. PATENT DOCUMENTS

| | | | | |
|---|---|---|---|---|
| 5,513,687 | A | 5/1996 | Tuzmen et al. | |
| 5,671,793 | A | 9/1997 | Lee | |
| 5,842,598 | A * | 12/1998 | Tsuchida | 221/258 |
| 6,065,524 | A * | 5/2000 | Rossini | 160/107 |
| 6,089,303 | A * | 7/2000 | Metcalf et al. | 160/176.1 R |
| 6,221,409 | B1 * | 4/2001 | Bueno Ceresuela | 426/104 |
| 6,257,303 | B1 * | 7/2001 | Coubray et al. | 160/188 |
| 6,298,897 | B1 * | 10/2001 | Metcalf et al. | 160/177 R |
| 6,308,764 | B1 * | 10/2001 | Lin | 160/177 R |
| 6,367,199 | B2 * | 4/2002 | Sedlak et al. | 49/340 |
| 6,701,669 | B1 | 3/2004 | Yorgason | |
| 6,805,186 | B1 * | 10/2004 | Nien | 160/177 R |
| 7,033,304 | B2 * | 4/2006 | Chuang et al. | 482/45 |
| 2003/0192654 | A1 | 10/2003 | Nien | |

FOREIGN PATENT DOCUMENTS

| | | | |
|---|---|---|---|
| DE | 34 03 920 | A1 | 1/1986 |
| DE | 299 17 875 | U1 | 2/2001 |
| DE | 103 24 029 | A1 | 12/2004 |
| GB | 380204 | | 9/1932 |
| GB | 451225 | | 7/1936 |
| GB | 2 267 927 | A | 12/1993 |

* cited by examiner 20
10
34
14
36
32
30
112
18
12
212
22
24/26
12
312

OPERATING DEVICE FOR A WINDOW COVERING

CROSS REFERENCE TO RELATED APPLICATION

This application claims priority to Great Britain patent application No. GB 0512576.0, filed 21 Jun. 2005, which is hereby incorporated by reference as if fully disclosed herein.

BACKGROUND OF THE INVENTION

1. Field of the Invention

The present invention relates to an operating device for imparting movement to a window covering, such as a roller blind, vertical blind and/or curtain.

2. Description of the Related Art

Various operating devices and mechanisms are known for imparting movement to a window covering. Common arrangements for roller blinds and vertical blinds, by way of example, provide an endless loop of cord or chain which, when pulled in one direction, draws or unfurls the blind, and when pulled in the other direction, reverses the movement. Curtains can have similar arrangements.

However, the use of an endless loop of cord or chain presents a recognised hazard. A number of children each year are killed or injured by accidentally entangling themselves with the loop of cord or chain, resulting in hanging.

A further problem presents itself in that, concerning vertical blinds, often a second endless loop of cord or chain is provided for operating the orientation of the slats. However, this second loop of cord or chain often becomes entangled with the other loop of cord or chain, making operation difficult. It can often be problematic, especially for an elderly or infirm person, to disentangle the loops of cord or chain.

The present invention seeks to provide a solution to these problems.

SUMMARY OF THE INVENTION

According to a first aspect of the invention, there is provided an operating device for a window covering, the device comprising a telescopically extendable and retractable handle and means for converting linear telescopic movement of the handle to rotational movement for moving the window covering.

Preferable and/or optional features of the first aspect of the invention are set forth in claims 2 to 4, inclusive.

According to a second aspect of the invention, there is provided an operating device, in accordance with the first aspect of the invention, in combination with a window covering.

Preferably, the window covering is a blind or curtain.

BRIEF DESCRIPTION OF THE DRAWINGS

The invention will now be more particularly described, by way of example only, with reference to the accompanying drawings, in which.

DETAILED DESCRIPTION OF THE PREFERRED EMBODIMENTS

Figure 1:
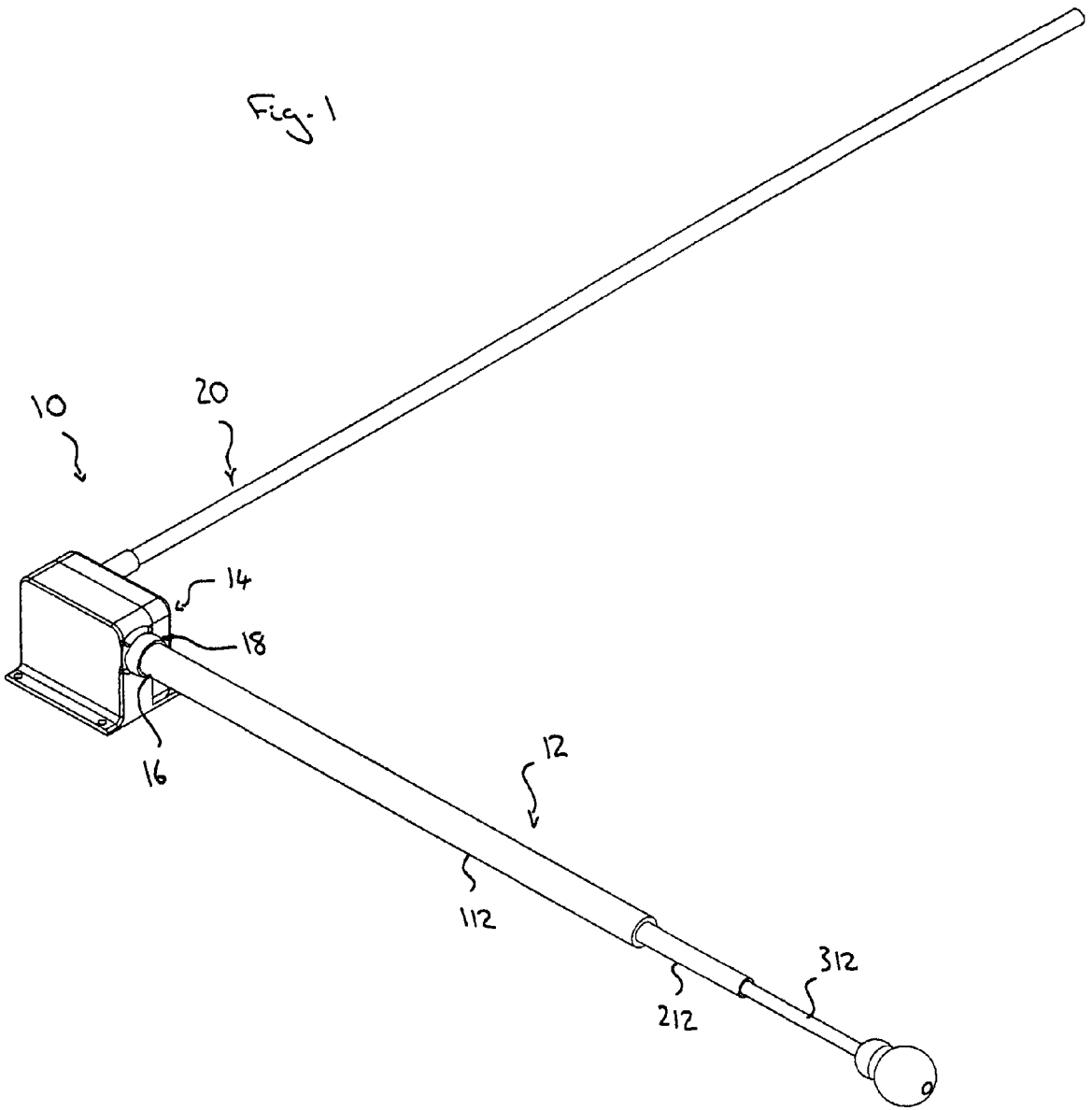
FIG. 1 is a perspective view of a first embodiment of an operating device, in accordance with the first aspect of the invention.

Referring to the drawings, there is shown an operating device 10 for a window covering, which comprises a telescopically extendable and retractable handle 12, a gear housing 14 to which a proximal end 16 of the telescopic handle 12 is connected via a ball-joint assembly 18, and a tubular rack housing 20 which extends from one side of the gear housing 14 transversely to the telescopic handle 12.

As shown, the telescopic handle 12 includes three parts 112, 212, 312 which are slidable coaxially relative to each other. However, the handle 12 can have two parts, or more than three parts, as necessity dictates.

Figure 2:
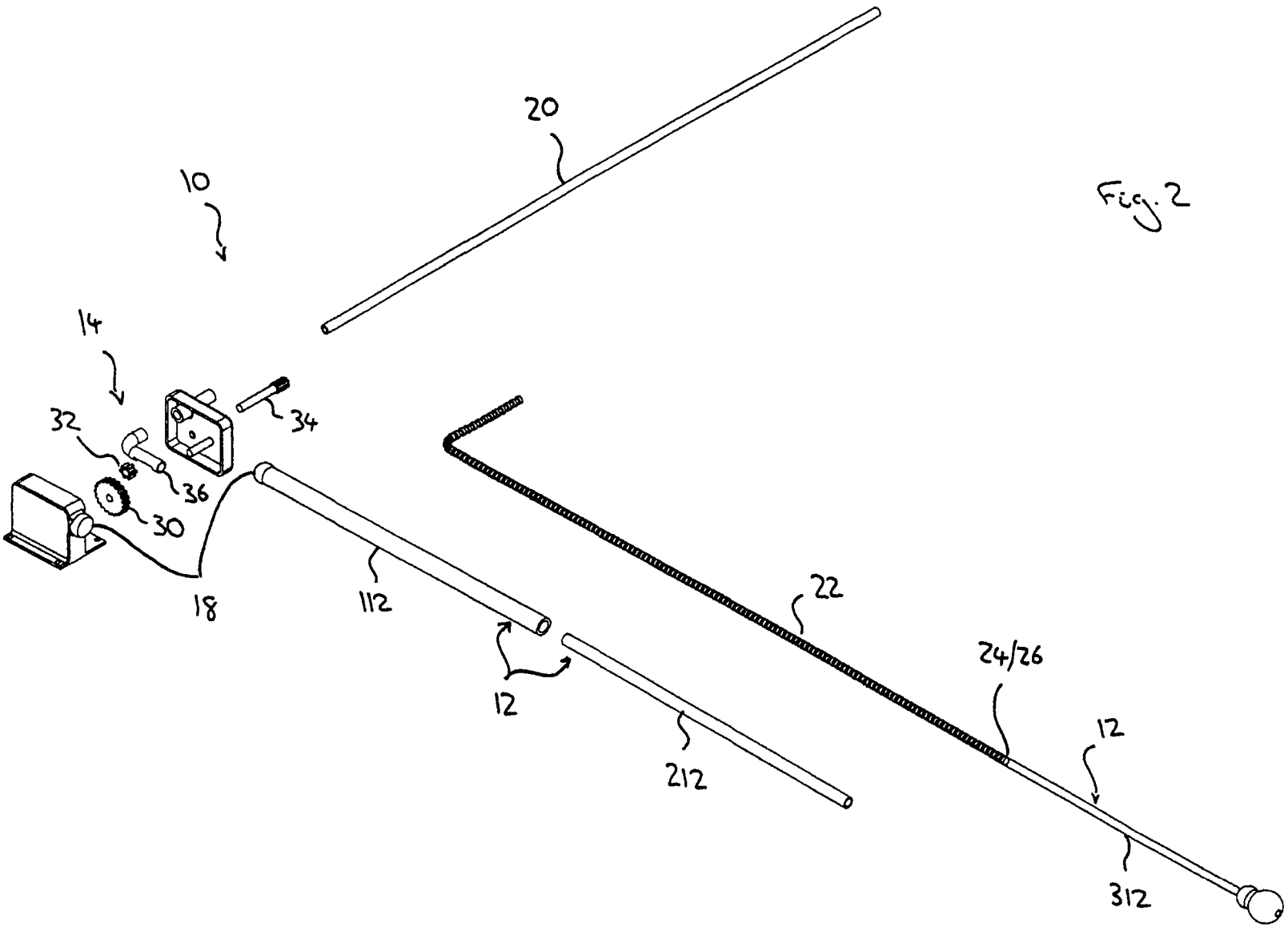
FIG. 2 is an exploded view of the operating device shown in FIG. 1.

As best seen in FIG. 2, an elongate flexible rack element 22 is provided which is, typically detachably, attached at one end 24 to the internal end 26 of the smallest diameter part 312 of the telescopic handle 12. The flexible rack element 22 extends coaxially inside the telescopic handle 12, passes into the gear housing 14 through the ball-joint assembly 18, and exits the gear housing 14 so as to be received in the rack housing 20.

Figure 4:
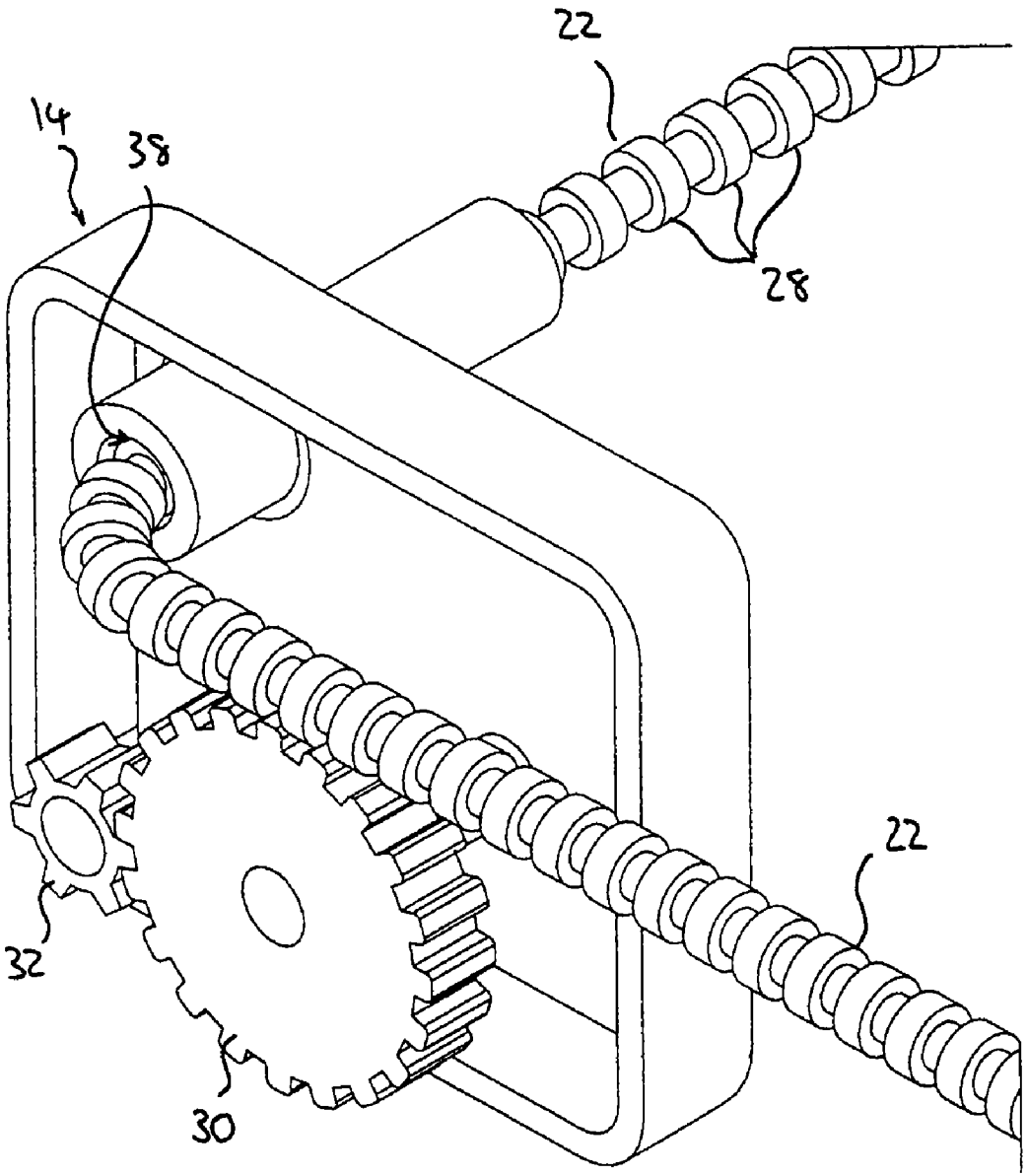
FIG. 4 is a view similar to that of FIG. 3, but with a rack guide removed for clarity.

The flexible rack element 22 is formed from metal or plastics material and, as can best be seen in FIG. 4, has a circular lateral cross-section. The flexible rack element 22 includes a multitude of ring shaped teeth 28 spaced from each other along the longitudinal extent of the rack element 22.

Figure 3:
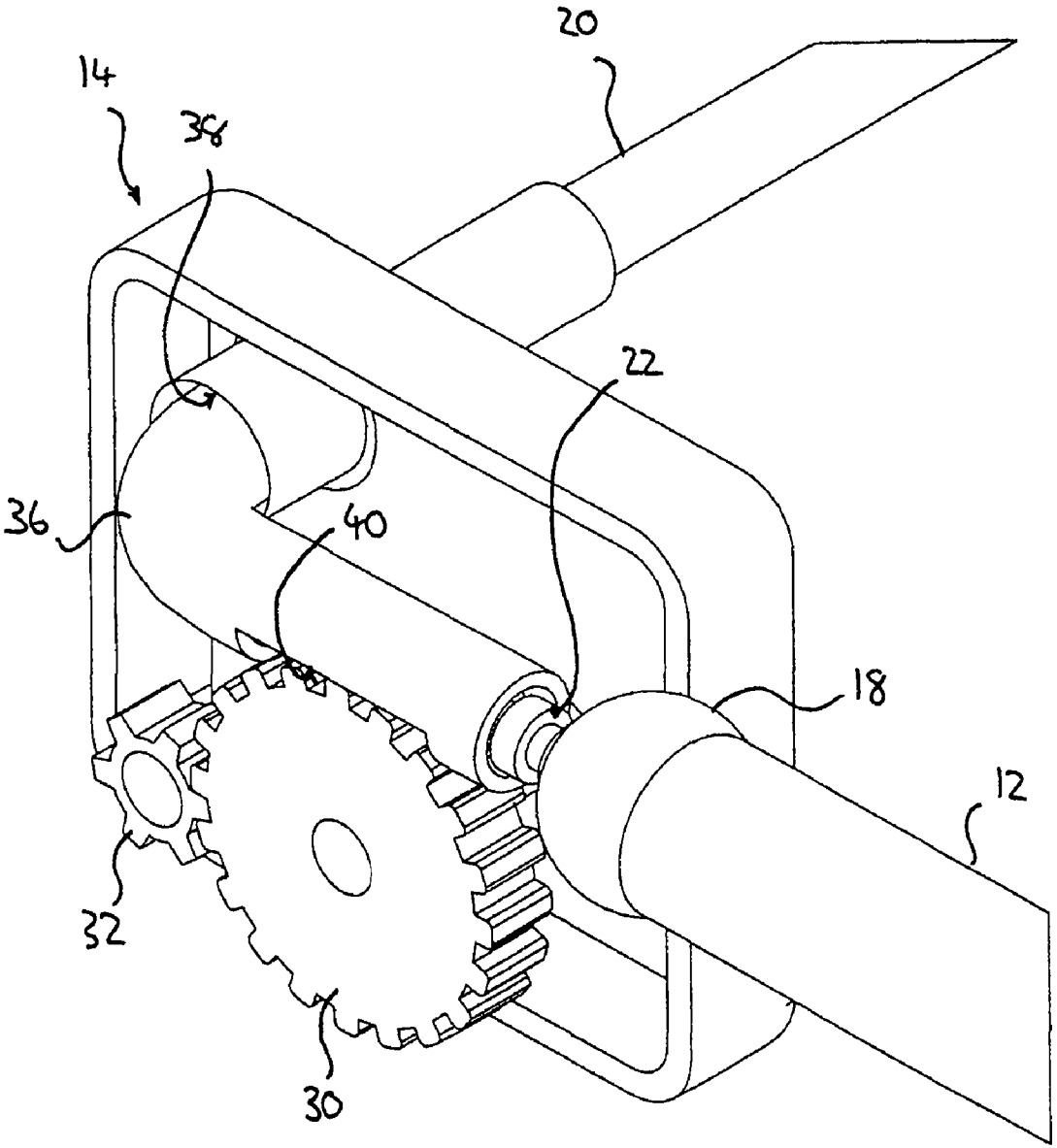
FIG. 3 is an enlarged view of a gear housing of the operating device shown in FIG. 1, with part of the housing removed.

As can be seen in FIG. 3, the gear housing 14 includes a pinion gear 30 mounted for rotation on one internal side of the gear housing 14, adjacent to the ball-joint assembly 18. The rack element 22 and pinion gear 30 together form a rack and pinion mechanism.

A spur gear 32 is also mounted for rotation in the gear housing 14 and meshes with the pinion gear 30. The spur gear 32 is connected to an output shaft 34 (FIG. 2), which extends externally of the gear housing 14 in parallel or substantially in parallel with the rack housing 20.

A rack guide 36 is also located within the gear housing 14 to guide the rack element 22 from the ball-joint assembly 18 to the opening 38 of the rack housing 20. The rack guide 36 is J-shaped or substantially J-shaped allowing the rack element 22 to deviate through 90 degrees before passing into the rack housing 20. A portion 40 of the back of the J-shaped rack guide 36 is open to enable the rack element 22 to mesh and thus drive the pinion gear 30.

The rack guide 36 is supported by the rack housing 20 and is spaced from the ball-joint assembly 18 to allow angular displacement of the handle 12.

From an extended condition, as the handle 12 of the operating device 10 is pushed into a retracted condition, the flexible rack element 22 is urged to pass through the gear housing 14 and into and along the rack housing 20. As the rack element 22 moves through the rack guide 36 in the gear housing 14, the pinion gear 30 rotates, which in turn drives the spur gear 32, causing the output shaft 34 to rotate. The output shaft 34 is connected to, for example, a roller blind mounting cylinder, thereby allowing the roller blind material to be unfurled or wound up, or to a movement mechanism of a vertical blind or curtain, thereby moving the blind or curtain(s) to cover or uncover a respective window.

When the handle 12 is extended from its retracted condition, the operation described above is reversed, and the blind or curtain(s) is/are moved in the other direction.

Figure 5:
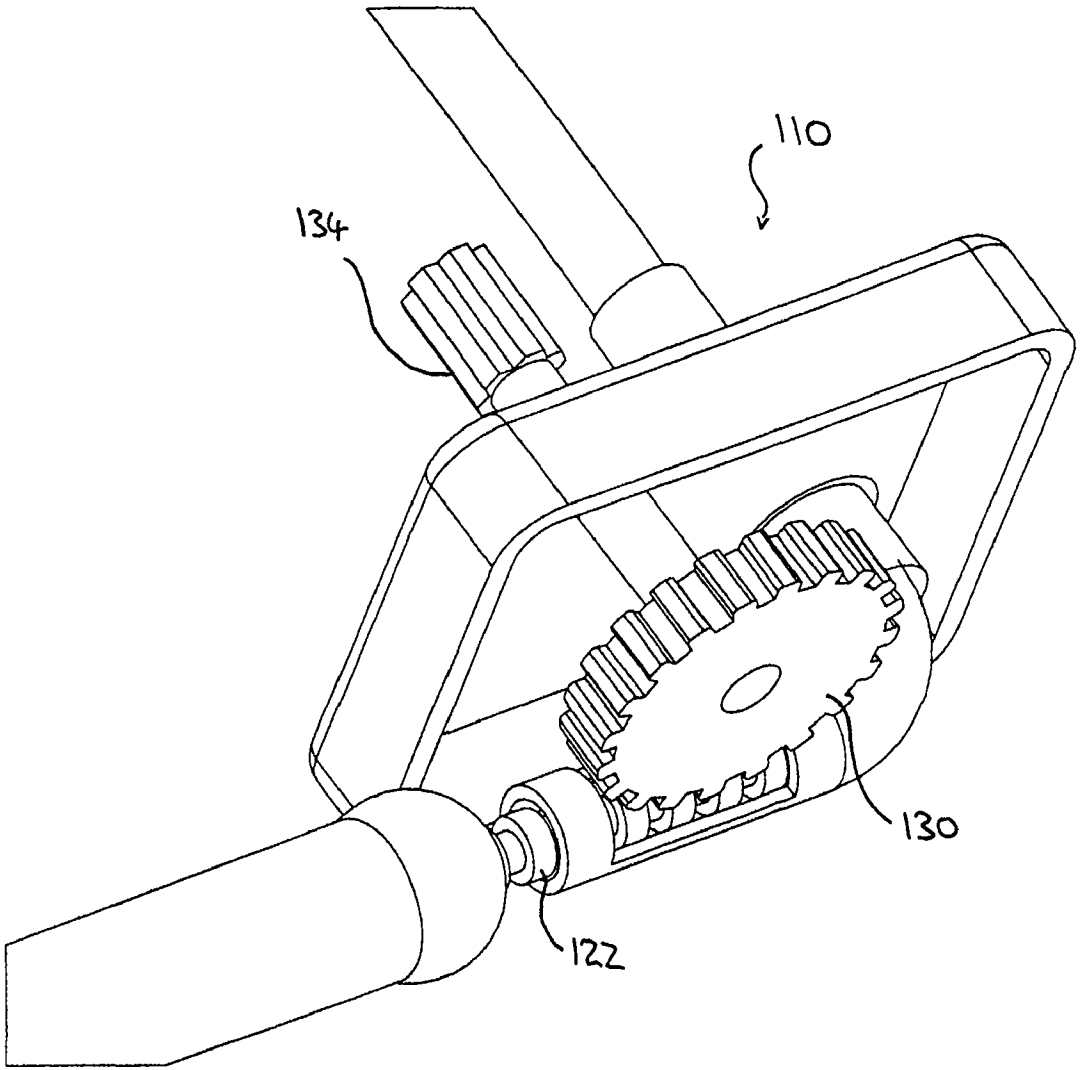
FIG. 5 is an enlarged perspective view from below of a second embodiment of an operating device, in accordance with the first aspect of the invention.

It will be realised that the spur gear can be dispensed with, as shown in a second embodiment of an operating device 110, shown in FIG. 5. In this case, the pinion gear 130 directly rotates the output shaft 134, due to movement imparted by the rack element 122.

More than one spur gear can be provided, and the rack element can be of non-circular lateral cross-section. Any suitable teeth can be provided on the rack element, for example, the teeth can be non-circular instead of ring-shaped. Alternatively, a single tooth in the form of a screw-thread or helical thread can be provided.

The gear housing could be replaced by any suitable support member, for example, simply being a plate.

The rack housing can be at any orientation to the gear housing/support member.

Conveniently, the operating device described above can be provided as a kit of parts to allow self- or home-assembly.

The operating device described above is particularly advantageous, since the rack housing can be located in parallel with, and hidden by, a blind or curtain track or mechanism extending across a window. The gear housing is unobtrusive, and can be easily be mounted to the surface adjacent the window.

It is thus possible to provide a window covering operating device which dispenses with the need for a loop of cord or chain in order to furl or unfurl the window covering. Safety is thus greatly improved, and ease of operation is simplified, especially for a user with low or reduced dexterity. It is also possible to provide an operating device which coverts linear movement of the handle into rotational movement for moving the window covering via a telescopic handle.

The embodiments described above are given by way of examples only, and other modifications will be apparent to persons skilled in the art without departing from the scope of the invention as defined by the appended claims.

The invention claimed is:

1. An operating device for a window covering, the device comprising a telescopically extendable and retractable handle having a small diameter part slidably positionable within a larger diameter part and linearly movable along a line of movement, means for converting linear telescopic movement of the handle to rotational movement of a driven member for moving the window covering, the movement converting means including a rack and pinion mechanism supported by a support member of the operating device, one end of a rack element of the rack and pinion mechanism being attached to a distal part of the small diameter part of the telescopic handle to be moved with said small diameter part whereby said rack element becomes a drive element, said driven member being a pinion gear provided on the support member and drivable by the rack element, said rack element being flexible and at least partially confined for sliding movement within said larger diameter part of said handle, and a tubular rack housing which extends perpendicularly to said line of movement, said tubular rack housing also confining movement of said flexible drive rack element.

2. An operating device as claimed in claim 1, wherein the rack element has a circular lateral cross-section.

3. An operating device as claimed in claim 2, wherein the pinion gear, in use, directly provides the rotational movement by which the window covering is moved.

4. An operating device as claimed in claim 2, wherein the movement converting means includes a spur gear drivable by the pinion gear, the in use spur gear providing the rotational movement by which the window covering is moved.

5. The combination of an operating device as claimed in any one of claims 1 or 2 or 3 or 4 and a window covering.

6. A combination as claimed in claim 5, wherein the window covering is a blind or a curtain.

* * * * *